US006061542A

United States Patent [19]

Minami et al.

[11] Patent Number: 6,061,542

[45] **Date of Patent: *May 9, 2000**

[54] IMAGE FORMING APPARATUS WHICH MODIFIES IMAGE FORMING CONDITION DEPENDING ON THE NUMBER OF PHOTOSENSITIVE DRUMS USED FOR A PARTICULAR IMAGE FORMATION

[75] Inventors: Takeshi Minami; Toru Kasamatsu, both of Toyokawa; Takeshi Satake, Sakai; Satoru Kawata, Toyohashi, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/137,151

[22] Filed: Aug. 20, 1998

[30] Foreign Application Priority Data

Aug. 22, 1997 [JP] Japan ..... 9-226209

[51] Int. Cl.[7] ..... G03G 15/01

[52] U.S. Cl. ..... 399/299; 399/303; 399/317

[58] Field of Search ..... 399/298, 299, 399/300, 303, 312, 313, 317

[56] References Cited

U.S. PATENT DOCUMENTS

| | | | |
|---|---|---|---|
| 5,282,012 | 1/1994 | Terada et al. | 399/299 X |
| 5,303,018 | 4/1994 | Terada et al. | 399/299 |
| 5,541,634 | 7/1996 | Otsuka et al. | 399/299 X |
| 5,669,054 | 9/1997 | Uchida et al. | 399/313 |
| 5,765,082 | 6/1998 | Numazu et al. | 399/299 |
| 5,893,017 | 4/1999 | Yamamoto | 399/299 |
| 5,905,930 | 5/1999 | Toyama et al. | 399/299 |

FOREIGN PATENT DOCUMENTS

| | | |
|---|---|---|
| 06258914 | 9/1994 | Japan . |
| 9-146383 | 6/1997 | Japan . |

OTHER PUBLICATIONS

Color Pagepresto N4 Brochure, and translation of the bottom right–hand corner of Pg. 4.

*Primary Examiner*—Susan S.Y. Lee
*Attorney, Agent, or Firm*—McDermott, Will & Emery

[57] ABSTRACT

An image forming apparatus is composed of an image holding component for holding an image, a first image forming device and a second image forming device for respectively forming a first image and a second image on a surface of the image holding component, a switching unit for switching a mode between a first mode and a second mode, the first mode being where the first image forming device and the second image forming device come into contact with the image holding component and the second mode being where the second image forming device and the image holding component do not come into contact and the first image forming device comes into contact with the image holding component, a detecting unit for detecting information concerning an image formed on the image holding component, and a modifying unit for modifying at least one of an image forming condition for the first image and an image forming condition for the second image in accordance with the information detected by the detecting unit. With this structure, the current mode is switched as necessary, so that needless wear and tear on the second image forming device is prevented. Also, the modifying unit modifies the image forming conditions as necessary, so that deterioration on a reproduced image caused by the mode switching is prevented. As a result, a high-quality image can be obtained.

51 Claims, 11 Drawing Sheets

IMAGE FORMING APPARATUS WHICH MODIFIES IMAGE FORMING CONDITION DEPENDING ON THE NUMBER OF PHOTOSENSITIVE DRUMS USED FOR A PARTICULAR IMAGE FORMATION

This application is based on an application No. 9-226209 filed in Japan, the content of which is hereby incorporated by reference.

BACKGROUND OF THE INVENTION (1) Field of the Invention

The present invention relates to an image forming apparatus, and particularly relates to a technique for changing an image forming condition of an image forming apparatus which forms an image using an electrophotographic method.

(2) Description of the Related Art

In recent years, so called "tandem-type" full-color image forming apparatuses have been increasingly used. In a tandem-type full-color image forming apparatus, image forming units including photosensitive drums as main components are set along a transport belt, and toner images for different colors formed on the image forming units are transferred onto a transfer material, such as a recording sheet, with the transferred images being superimposed.

Using this tandem-type image forming apparatus, a full-color image is obtained after the recording sheet passes by the photosensitive drums only once, thereby improving a copying operation speed. However, when only one image forming unit is used for forming a black image (referred to as the "monochrome image" hereinafter), the recording sheet still comes into contact with the other three image forming units during transportation. For this reason, the three image forming units which are not used for the image formation still need to be rotated. This results in needless wear and tear on the surfaces of the three photosensitive drums and cleaning members that are provided for the photosensitive drums, shortening the lifespans of these components. Also, toner in developing units is unnecessarily consumed.

To address this problem, Japanese Laid-Open Patent Applications No. 6-258914 discloses a tandem-type image forming apparatus which has a transport belt for transporting a recording sheet come in contact with all of photosensitive drums when forming a full-color image (referred to as the "color copy mode" hereinafter), and has the transport belt move downward using a moving mechanism to separate the transport belt from the photosensitive drums that are not used when forming a black image using only the image forming unit for black (referred to as the "monochrome copy mode" hereinafter). Here, rotations of the photosensitive drums separated from the transport belt are stopped, thereby preventing needless wear and tear on the photosensitive drums.

However, when using the image forming apparatus having such a moving mechanism that separates the photosensitive drums and the transport belt, tension of the transport belt may fluctuate and the transport belt may slide along a driving roller due to the moving operations of the moving mechanism. Also, it is also difficult for the moving mechanism to precisely position the transport belt at the uppermost and lowermost positions. If the transport belt is not stopped at the correct uppermost and lowermost positions, transfer positions of the photosensitive drums are inconsistent. As a result, every time the transport belt is shifted by the moving mechanism, transfer positions of the photosensitive drums are slightly changed, thereby causing color displacements on a transferred color image.

This problem is described for an image forming apparatus that switches the copy mode between the monochrome copy mode and the color copy mode. However, when forming an image selectively using a plurality of image forming means, like photosensitive drums, problems, such as the aforementioned color displacements, result in lower quality for the reproduced image.

SUMMARY OF THE INVENTION

The first object of the present invention is to provide a novel image forming apparatus which prevents needless wear and tear on the image forming means by selectively using the plurality of image forming means and also prevents deterioration on the image caused by the switching of the copy modes, thereby forming a high-quality image.

The second object of the present invention is to provide a tandem-type full-color image forming apparatus which prevents needless wear and tear on the components by separating the transfer material supporting surface of the transport belt and the photosensitive drums that are not used in the monochrome copy mode when forming a monochrome image, and which prevents color displacements caused by the shift operation of the transport belt in the color copy mode when forming a full-color image, thereby forming a high-quality image.

The third object of the present invention is to provide a tandem-type image forming apparatus which modifies the transfer positions when the image forming units are changed in the monochrome copy mode and the color copy mode.

The first object of the present invention can be achieved by an image forming apparatus made up of: an image holding component for holding an image; a first image forming device for forming a first image on a surface of the image holding component; a second image forming device for forming a second image on the surface of the image holding component; a switching unit for switching a mode between a first mode and a second mode, the first mode being where the first image forming device and the second image forming device come into contact with the image holding component and the second mode being where the second image forming device and the image holding component do not come into contact and the first image forming device comes into contact with the image holding component; a detecting unit for detecting information concerning an image formed on the surface of the image holding component; and a modifying unit for modifying at least one of an image forming condition for the first image and an image forming condition for the second image, in accordance with the information detected by the detecting unit.

With this structure, needless wear and tear on the plurality of image forming units can be prevented by selectively using the plurality of image forming units when image formation is performed. In addition, deterioration on the transferred image caused by the shift operation is prevented, so that a high-quality image can be obtained.

The second object of the present invention can be achieved by an image forming apparatus made up of: an image holding component for holding an image; a first image forming device for forming a first image on a surface of the image holding component and including a photosensitive component, a latent image forming unit for forming a latent image on the photosensitive component, and a developing unit for developing the latent image; a second image forming device for forming a second image on the surface of the image holding component and including at least two photosensitive components, at least two latent image forming units for each forming a latent image on the corresponding photosensitive component, and at least two developing units for each developing the corresponding latent image; a switching unit for switching a mode between a first mode and a second mode, the first mode being where the first image forming device and the second image forming device come into contact with the image holding component and the second mode being where the second image forming device and the image holding component do not come into contact and the first image forming device comes into contact with the image holding component; a detecting unit for detecting information concerning an image formed on the surface of the image holding component; and a modifying unit for modifying at least one of an image forming condition for the first image and an image forming condition for the second image, in accordance with the information detected by the detecting unit, wherein the first image forming device forms a black image on the photosensitive component and the second image forming device forms an image of a different color on each of the photosensitive components, with none of the different colors being black.

With this structure of the tandem-type full-color image forming apparatus, the photosensitive drums which are not used in the monochrome copy mode and the transporting unit are separated, so that needless wear and tear on the photosensitive drums can be prevented. In the color copy mode, meanwhile, deterioration on the transferred image caused by the shift operation of the transporting unit can be prevented, so that a high-quality image can be obtained.

BRIEF DESCRIPTION OF THE DRAWINGS

These and the other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENT

The following is a description of embodiments of the image forming apparatus of the present invention. In these embodiments, a tandem-type digital full-color copying machine (referred to as the "copier" hereinafter) is used as an example of such an image forming apparatus.

First Embodiment (1) Overall Construction of the Copier

Figure 1:
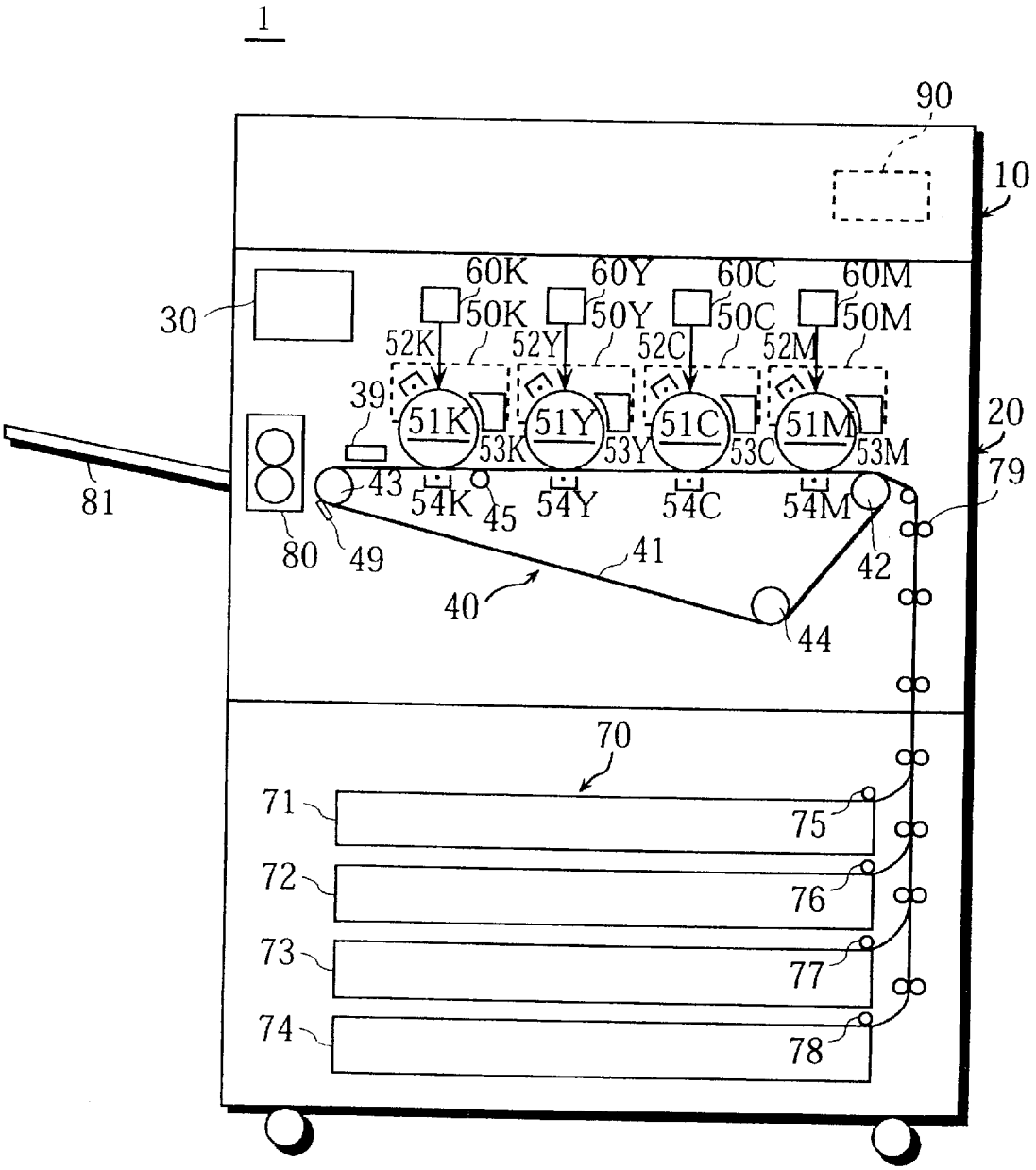
FIG. 1 shows a construction of a tandem-type full-color image forming apparatus of the first embodiment of the present invention.

FIG. 1 shows the overall construction of a copier 1. As shown in FIG. 1, the copier 1 is composed of an image reading unit 10 for reading a document image and a printing unit 20 for reproducing the read image on a recoding sheet by printing.

The image reading unit 10 is a well-known device that reads an image of a document set on a platen glass (not illustrated) using a scanner that moves laterally. The document image obtained by a light emission of an exposure lamp provided for the scanner is converged by a converging lens and separated into color lights with wavelengths for red (R), green (G), and blue (B). These color lights are respectively guided into CCD image sensors for R, G, and B. Analogue signals from the CCD image sensors are converted into digital signals by an A/D converter. As a result, the image data of the document for R, G, and B is obtained.

Various data processes are performed by a control unit 30 on the image data for each color obtained by the image reading unit 10. The image data is further converted into print data for reproduction colors magenta, cyan, yellow, and black. Hereinafter, these reproduction colors magenta, cyan, yellow, and black are respectively referred to as M, C, Y, and K and components related to these colors are assigned numerals with a corresponding M, C, Y, or K.

The image data for each reproduction color is stored in an image memory 33 (shown in FIG. 4) provided in the control unit 30. After necessary image correction processing is performed for a displacement correction, the image data is read from the image memory 33 for each scanning line and converted into driving signals of laser diodes in synchronization with a timing at which a recording sheet is supplied.

The printing unit 20 forms an image using a well-known electrophotographic method, and is composed of a recording sheet transporting unit 40 with a transport belt 41 being extended, image processing units 50M to 50K which are set with a certain distance between them along the transport belt 41 from an upstream side to a downstream side in a transportation direction of the recording sheet (hereinafter those sides are simply referred to as the "upstream side" and the "downstream side"), exposure units 60M to 60K respectively provided for the image processing units 50M to 50K for scanning surfaces of photosensitive drums, a paper supplying unit 70 for supplying the recording sheet to the upstream side of the recording sheet transporting unit 40, and a fixing unit 80 set at the downstream side.

Each of the exposure units 60M to 60K includes a laser diode for receiving the driving signal from the control unit 30 and emitting a laser beam, and also includes a polygon mirror for deflecting the laser beam which scans a corresponding surface of photosensitive drums 51M to 51K in the main scanning direction.

The image processing units 50M to 50K are respectively provided with the photosensitive drums 51M to 51K, sensitizing chargers 52M to 52K, developing units 53M to 53K, and transfer chargers 54M to 54K. These components provided for each of the image processing units 50M to 50K are set in one casing for easy maintenance such as a replacement of a component.

The paper supplying unit 70 includes paper cassettes 71 to 74 for each loading a different size of recording sheets, pick-up rollers 75 to 78 for feeding the recording sheet from a corresponding paper cassette 71 to 74, and a resist roller 79 for supplying the recording sheet to the transport belt 41 at an appropriate timing.

Before the exposure units 60M to 60K start exposing, cleaners (not illustrated) remove toner particles remaining on the surfaces of the photosensitive drums 51M to 51K and eraser lamps (not illustrated) eliminate the charge on the photosensitive drums 51M to 51K. Then, the sensitizing chargers 52M to 52K uniformly charge the photosensitive drums 51M to 51K and the laser beams scan the corresponding surfaces of the photosensitive drums 51M to 51K. As a result, an electrostatic latent image is formed on each surface of the photosensitive drums 51M to 51K.

The electrostatic latent image is then developed by a corresponding developing unit 53M to 53K. In this way, M, C, Y, and K toner images are respectively formed on the corresponding surfaces of the photosensitive drums 51M to 51K. These toner images are sequentially transferred at transfer positions onto the recording sheet transported by the recording sheet transporting unit 40 via electrostatic actions of the transfer chargers 54M to 54K set on a lower surface of the transport belt 41.

Toner image formations on the photosensitive drums 51M to 51K are performed in synchronization with timings at which the recording sheet reaches the corresponding transfer positions, so that the toner images are transferred onto the recording sheet at the correct position.

After the toner images are transferred onto the recording sheet, the recording sheet is transported by the transport belt 41 to the fixing unit 80, where the toner particles on the recording sheet are fused and fixed in place by a pair of rollers with high heat. Finally, the recording sheet is discharged onto a discharge tray 81.

A cleaning blade 49 is set under a slave roller 43, with the transport belt 41 in between them, for removing toner of resist marks on the transport belt 41 having been transferred for the detection of image displacements.

An operation panel 90 is provided on an optimum position on the top of the image reading unit 10. The user can input an instruction of copying start, set the number of copies, and specify a copy mode using keys on the operational panel 90.

Figure 2:
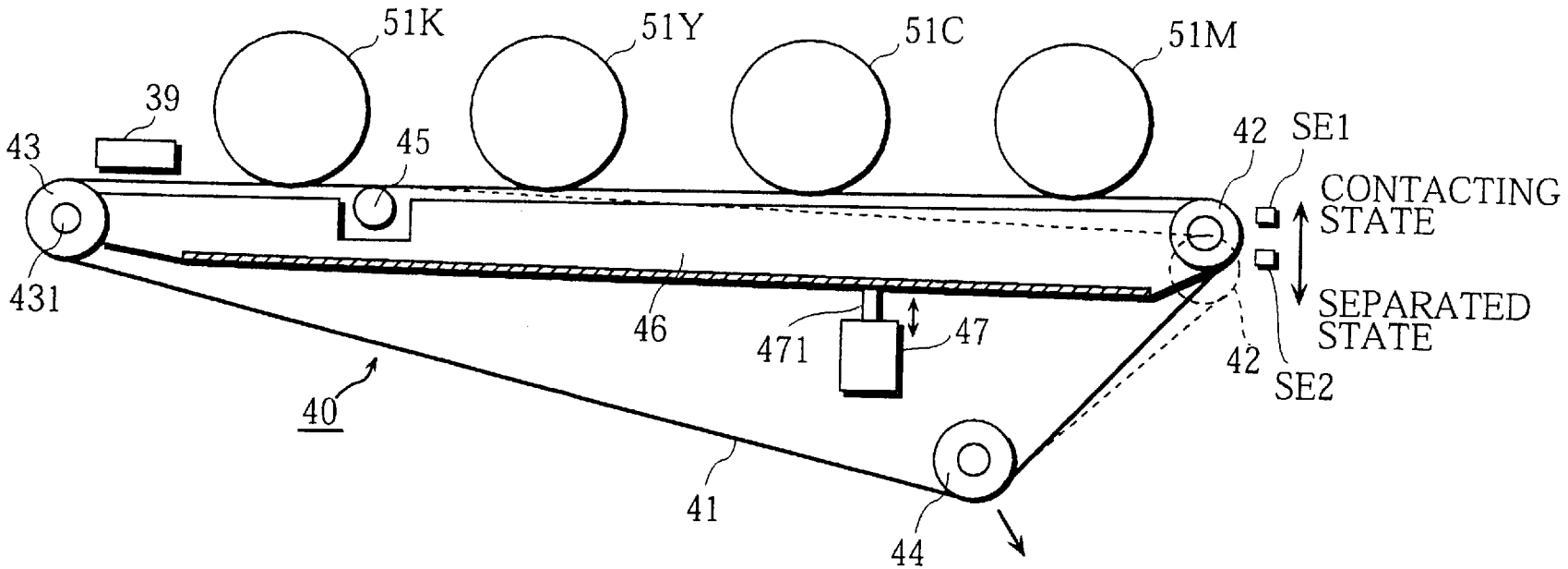
FIG. 2 shows a construction of a recording sheet transporting unit of the tandem-type full-color image forming apparatus.

FIG. 2 shows an enlarged view of the main components of the recording sheet transporting unit 40. As shown in FIG. 2, the recording sheet transporting unit 40 is composed of the transport belt 41 that runs over a driving roller 42, a slave roller 43, a tension roller 44, and an auxiliary roller 45.

The driving roller 42 is held on the right end of a shift frame 46 to freely rotate. The shift frame 46 is held to rotate clockwise and counterclockwise about a rotational shaft 431 of the slave roller 43. The driving roller 42 is driven by a stepping motor (not illustrated) provided for the shift frame 46, and the rotational speed of the driving roller 42 is controlled by the control unit 30 so that the transportation speed of the transporting surface of the transport belt 41 is equal to the circumferential speed of the photosensitive drums 51M to 51K.

The shift frame 46 is shifted upward and downward by a solenoid 47. More specifically, when image formation is performed in the color copy mode, the shift frame 46 is shifted upward as indicated by a solid line in FIG. 2 so that the photosensitive drums 51M to 51K come in contact with the recording sheet transporting surface of the transport belt 41. This state of the shift frame 46 is referred to as the "contacting state" hereinafter. Meanwhile, when image formation is performed in the monochrome copy mode, a rod 471 of the solenoid 47 is drawn backward so that the shift frame 46 is shifted downward. Here, since the auxiliary roller 45 is held on a main frame (not illustrated), only the upstream side of the transporting surface of the transport belt 41 from the auxiliary roller 45 is shifted downward as indicated by a dash line in FIG. 2. This state of the shift frame 46 is referred to as the "separated state" hereinafter. In this way, the photosensitive drums 51M to 51Y which are not used for forming a black image are separated from the transporting surface of the transport belt 41 in the monochrome copy mode. As a result, no friction occurs between the photosensitive drums 51M to 51Y and the transport belt 41 when the photosensitive drums 51M to 51Y are stopped in the monochrome copy mode. In addition, needless wear and tear on the photosensitive drums 51M to 51Y and other components is prevented without causing adverse effect to the image formation.

A pair of bearing units of the tension roller 44 is energized in the direction of the arrow in FIG. 2 by a pair of energizing devices (not illustrated) using elastic members, such as springs. Thus, when the state of the shift frame 46 is changed between the separated state and the contacting state, the tension of the transport belt 41 is kept constant.

Sensors SE1 and SE2 are respectively used for detecting the contacting state and the separated state of the shift frame 46, and each includes a reflectance-type photo sensor and a limit switch.

A resist mark detecting unit 39 is set above the transport belt 41 on the downstream side for detecting the resist mark for each color transferred onto the transport belt 41 at one longitudinal side.

Figure 3:
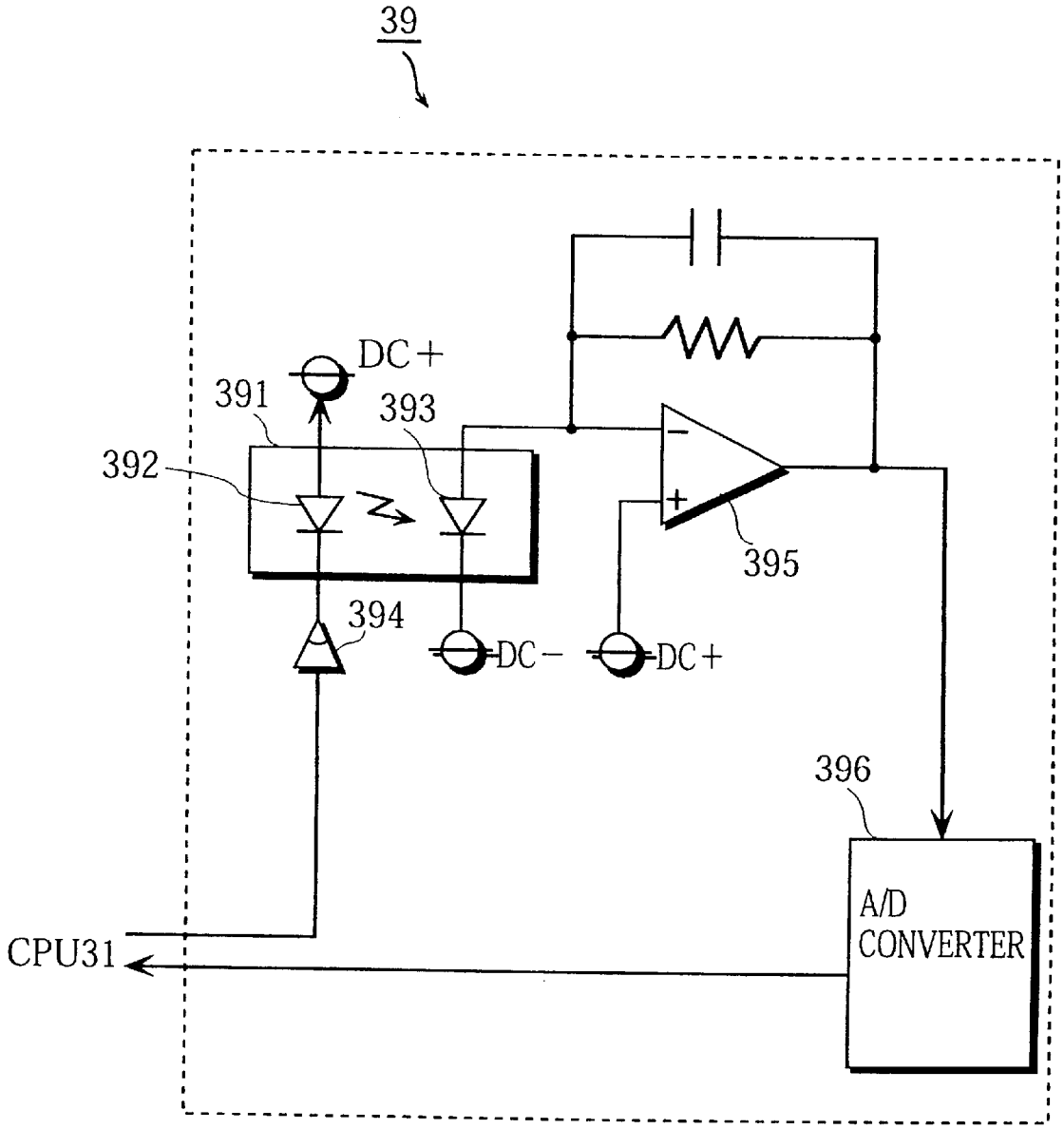
FIG. 3 shows a circuit construction of a resist mark detecting unit.

FIG. 3 shows a circuit example of the resist mark detecting unit 39.

The resist mark detecting unit 39 is composed of a reflectance-type photo sensor 391 that includes an LED (light-emitting diode) 392 and a photo diode 393. Receiving a control signal from a CPU 31 (shown in FIG. 4) of the control unit 30, an LED driving element 394 has the LED 392 emit a light which is then converged by a converging lens (not illustrated). This light exposes the surface of the transport belt 41. The light reflected off the transport belt 41 is received by the photo diode 393 and converted into an electric signal. This detection signal is amplified by an amplifier 395. The amplified detection signal is further converted into a multivalued digital signal by the A/D converter and outputted to the CPU 31.

Receiving the detection signal of the resist mark for each color, the control unit 30 corrects an image writing position on the corresponding photosensitive drum 51M to 51K for each pixel, thereby preventing color displacements on a transferred image.

(2) Construction of the Control Unit 30

Figure 4:
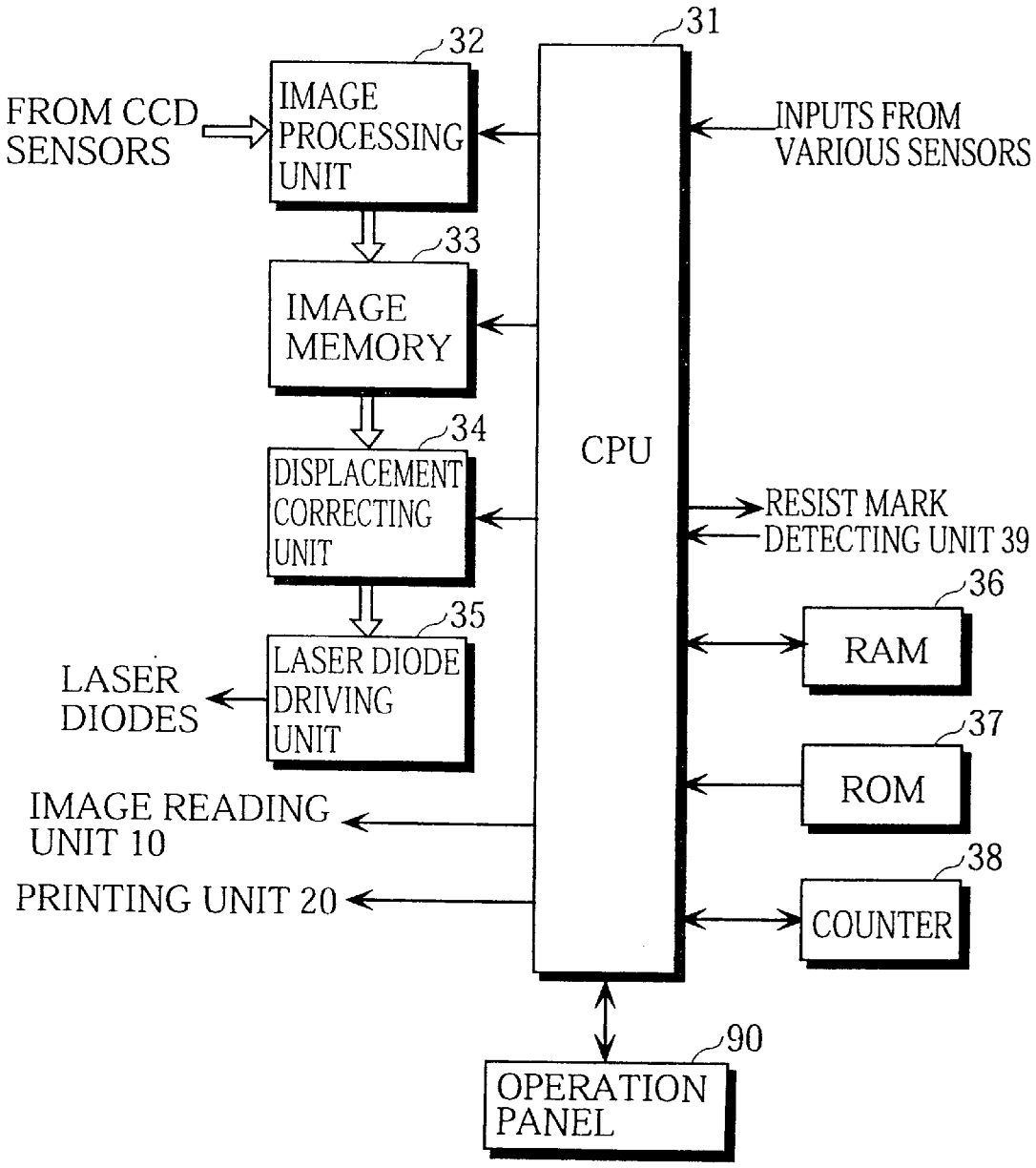
FIG. 4 is a block diagram showing a construction of a control unit provided in the tandem-type full-color image forming apparatus.

The construction of the control unit 30 is described, with reference to FIG. 4.

As shown in FIG. 4, the control unit 30 is composed of a CPU 31, an image processing unit 32, an image memory 33, a displacement correcting unit 34, a laser diode driving unit 35, a RAM 36, a ROM 37, and a counter 38.

The image processing unit 32 converts the electric signals for R, G, and B obtained by scanning the document into the multivalued digital signals to generate image data. After performing correction processing, such as a shading correction process and an edge sharpening process, the image processing unit 32 generates image data for M, C, Y, and K and outputs the image data to the image memory 33, where the image data is stored for each reproduction color. In doing so, the image processing unit 32 stores a storing position (or, an address) of the image data of each document in the image memory 33 corresponding to the page number of the document in a management table provided in the RAM 36.

The displacement correcting unit 34 corrects a storing position of the image data for each pixel to generate corrected image data, in accordance with an instruction from the CPU 31.

The laser diode driving unit 35 drives the laser diodes in accordance with the corrected image data.

The RAM 36 temporarily stores various control variables and present settings, such as the number of copies and the copy mode, that have been inputted from the operation panel 90 and also stores control flags and the management table.

The ROM 37 stores programs required for the various control operations, such as a scanning operation of the image reading unit 10, an image forming operation of the printing unit 20, and a image displacement correction. Also, the ROM 37 stores data required for printing the resist mark for each color.

The counter 38 counts the number of color image formations having been performed after a displacement detecting operation.

While receiving inputs from various sensors, the CPU 31 reads necessary programs from the ROM 37 to control image data processing performed by the image processing unit 32, the image memory 33, and the displacement correcting unit 34. Also, the CPU 31 executes a smooth copy operation by controlling the operation timings of the image reading unit 10 and the printing unit 20.

Figure 5:
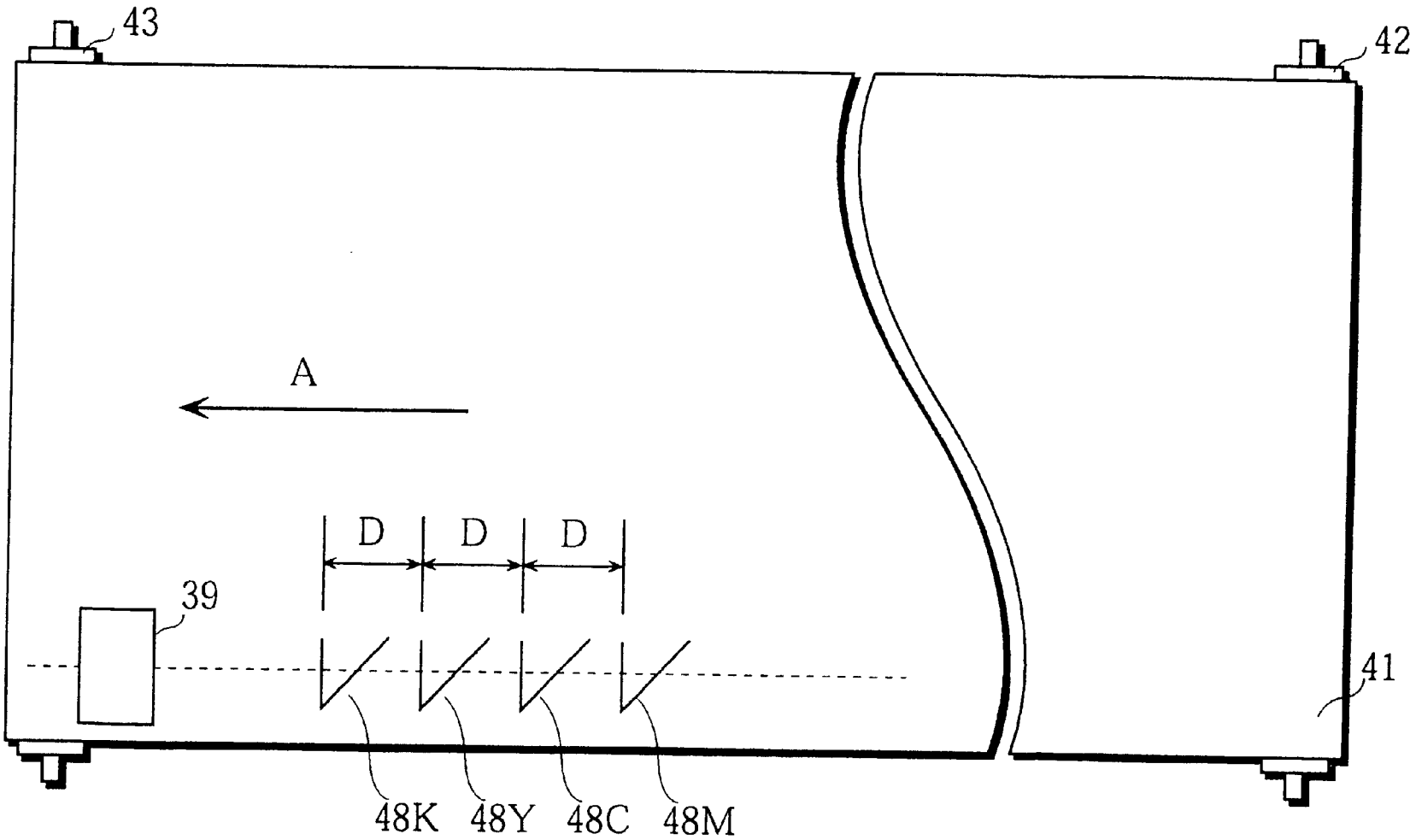
FIG. 5 shows an example of resist marks formed on a transport belt.

FIG. 5 shows an example of resist marks on the transport belt 41 that are formed when the displacement detecting operation is performed.

Resist marks 48M to 48K are formed in the same shape, and are V-shaped in FIG. 5. The V-shaped resist mark is composed of a first line making a right angle with a transportation direction A when no displacement is detected and a second line forming a 45° angle with the first line. The image data for printing the resist marks 48M to 48K is stored in the ROM 37. When the image writing positions on the photosensitive drums 51M to 51K are correct and the transfer positions are also correct, this means that no color displacement occurs. In this case, the resist marks 48M to 48K are formed on the same line that is parallel to the transportation direction A as shown in FIG. 5, with the first lines being formed with a distance D between them in the transportation direction A.

As the transport belt moves, the first and second lines of the resist marks 48M to 48K formed on the transport belt 41 by the photosensitive drums 51M to 51K are detected by the photo sensor 391 of the resist mark detecting unit 39 on a detection line indicated by a dash line in FIG. 5. The detection signal is converted by an A/D converter 396 and outputted to the CPU 31.

Figure 6:
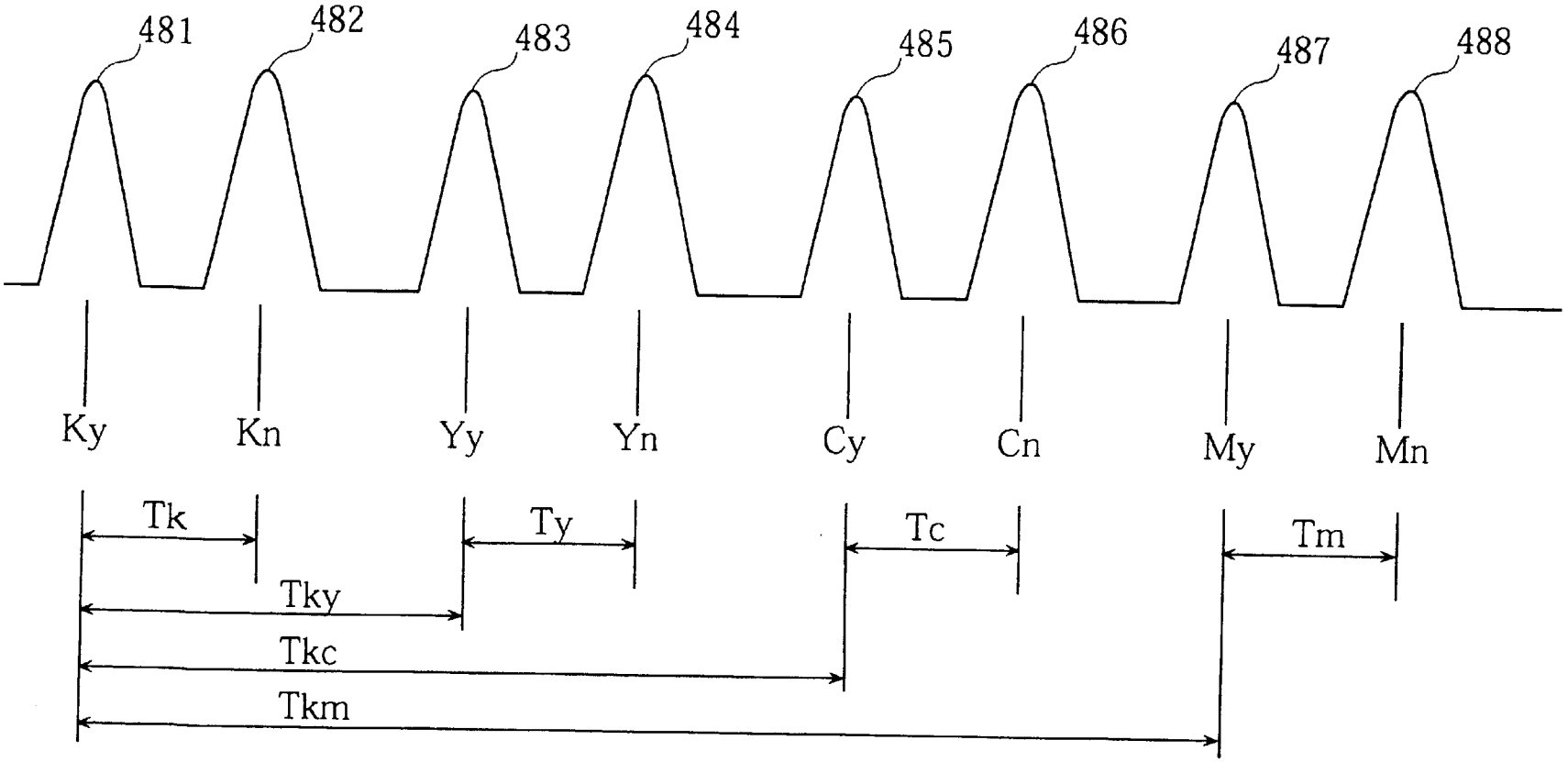
FIG. 6 shows a representation of detection signals obtained by a resist mark detection unit.

FIG. 6 shows a representation of detection signals. Detection signals 481 to 488 are obtained when the first and second lines of the resist marks 48M to 48K are sequentially detected from the downstream side shown in FIG. 5. Since the photo diode 393 shown in FIG. 3 has a certain sensing range, the waveform of each detection signal is a mountainous wave. For this reason, it is hard to determine each precise position of the first and second lines of the resist marks 48M to 48K.

To address this problem, the CPU 31 obtains the central position (or, peak position) of each waveform as a standard position using a barycenter calculating method. This standard position is determined as a correct position of the corresponding first or second line. In FIG. 6, Ky to Mn are the standard positions of the detection signals 481 to 488. More specifically, Ky is the standard position of the first line of the resist mark 48K and Kn is the standard position of the second line of the resist mark 48K. Similarly, Yy to Mn are the standard positions of the resist marks 48Y to 48M.

The CPU 31 includes a clock generating circuit and stores a clock value in the RAM 36 when each standard position of the first and second lines of the resist marks 48M to 48K is detected. By calculating differences among the clock values, the CPU 31 obtains times Tk to Tm respectively taken from the detection of the first lines to the detection of the second lines of the resist marks 48K to 48M and times Tky, Tkc, and Tkm respectively taken from the detection of the first line of the resist mark 48K to the detections of each first line of the resist marks 48Y to 48M.

Suppose that a running speed of the transport belt 41 is V when image formation is being performed. Here, a distance between the first line of the resist mark 48K and the first line of the resist mark 48Y is V•Tky. Similarly, distances between the first line of the resist mark 48K and the first lines of the resist marks 48C and 48M are respectively V•Tkc and V•Tkm.

As described above, when no displacement occurs, the respective distance between the resist marks 48M to 48K is the distance D. The displacements of the first lines of the resist marks 48Y to 48M with the resist mark 48K being the standard mark, that is, the displacements in the sub-scanning direction, are calculated by the following equations. Here, the displacements in the sub-scanning direction are respectively referred to as D1ky, D1kc, and D1km.

$$D1ky=D-V\bullet Tky$$

$$D1kc=2D-V\bullet Tkc$$

$$D1km=3D-V\bullet Tkm$$

A distance between the first line and the second line (referred to as the "line distance" hereinafter) of each resist mark 48K to 48M is respectively referred to as Dk, Dy, Dc, and Dm. These distance values are calculated by the following equations using the times Tk to Tm respectively taken from the detection of the first lines to the detection of the second lines of the resist marks 48M to 48K.

$$Dk=V\bullet Tk$$

$$Dy=V\bullet Ty$$

$$Dc=V\bullet Tc$$

$$Dm=V\bullet Tm$$

Differences between the line distance Dk and the line distances Dy, Dc, and Dm are the displacements in the main scanning direction and referred to as D2ky, D2kc, and D2km. These differences are calculated by the following equations.

$$D2ky=Dk-Dy$$

$$D2kc=Dk-Dc$$

$$D2km=Dk-Dm$$

As described above, each first line of the resist marks 48M to 48K makes a right angle with the transportation direction (or, the sub-scanning direction) and each second line of the resist marks 48M to 48K forms a 45° angle with the corresponding first line. Thus, the respective differences between the line distance of the resist mark 48K and the line distances of the resist marks 48M to 48Y are equivalent to the displacements between the image writing position for black and the image writing positions for magenta, cyan, and yellow in the main scanning direction.

In this way, the CPU 31 calculates the displacements D1ky, D1kc, and D1km of the image writing positions in the sub-scanning direction and the displacements D2ky, D2kc, and D2km in the main scanning direction, with the image writing position for black being the standard writing position.

The CPU 31 transmits these displacements to the displacement correcting unit 34, which includes an address correcting unit and a corrected image memory for each reproduction color.

The address correcting unit corrects an address of the image data read from the image memory 33 for each pixel in accordance with the calculated displacement and stores the corrected address in the corrected image memory. In this way, the image writing positions on the photosensitive drums are corrected.

As one example, when a yellow image is corrected, the displacements of the resist mark 48Y in the main scanning and sub-scanning directions are D1ky and D2ky, with the resist mark 48K being the standard mark. Therefore, the addresses are corrected so that the values of D1ky and D2ky become as close to "0" as possible when the image is transferred onto the recording sheet.

Suppose that a distance between pixels of a reproduced image is h. When the recording density of the image is 400 dpi, for example, h is about 64 $\mu$m. The correct address is determined by shifting the number of pixels obtained by D1ky/h in the sub-scanning direction and the number of pixels obtained by D2ky/h in the main scanning direction. Here, the fractional portion of the number of pixels may be dropped, or alternatively, the number of pixels may be obtained by rounding off the value to the nearest integer. The obtained correct address is then stored in the corrected image memory. Note that the direction to which the obtained number of pixels are shifted in the main scanning direction and the sub-scanning direction depends on whether the number of pixels to be shifted is a positive or negative value.

Similarly, the corrected cyan and magenta images are obtained in accordance with the displacements based on the resist mark 48K as the standard mark. As a result, a full-color image can be obtained without color displacements.

(3) Control Operation by the Control Unit 30

The following is a description of the control operation for the image formation performed by the control unit 30, with reference to the flowcharts.

Figure 7:
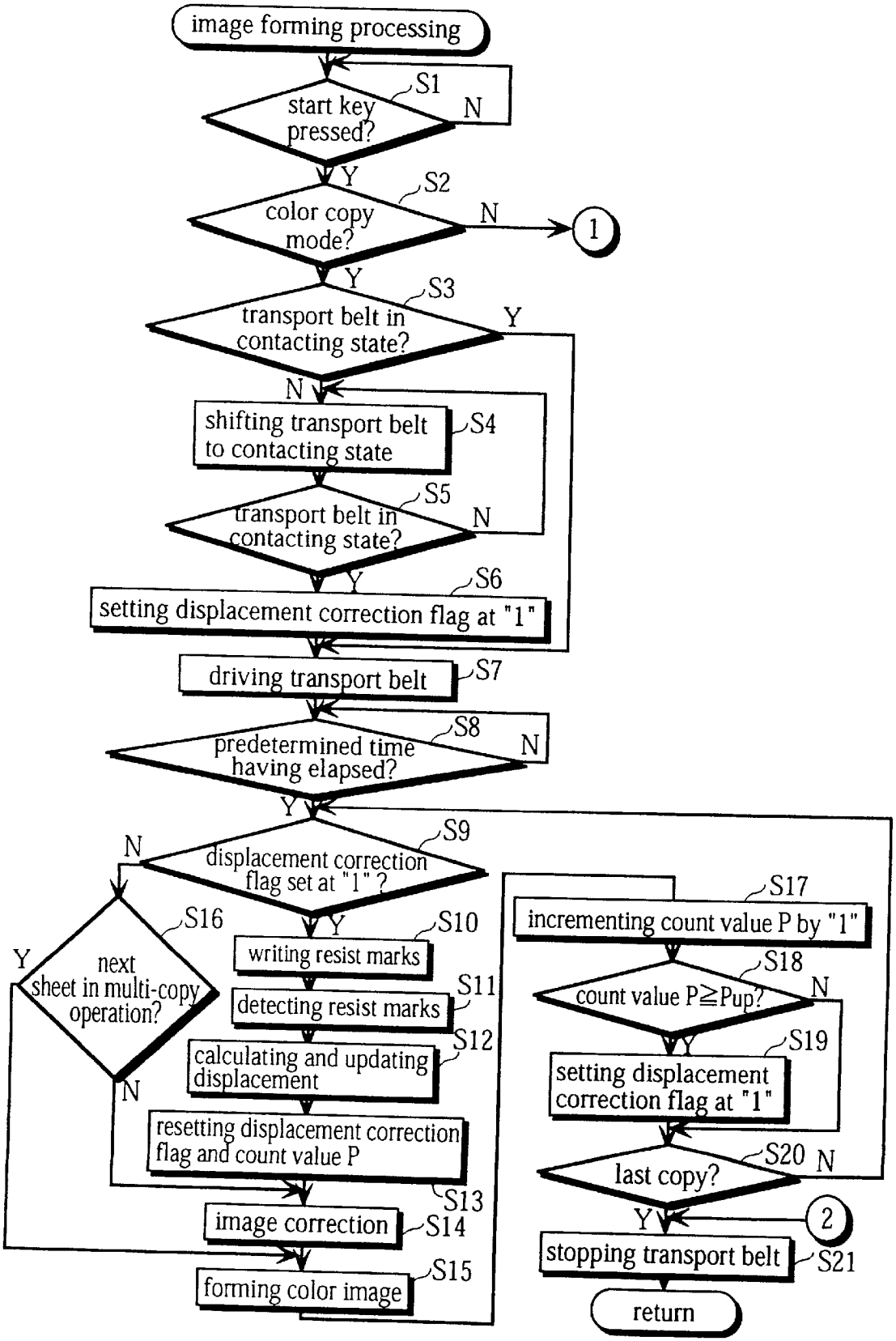
FIG. 7 is a flowchart showing an operation for the image forming processing performed by the control unit.
Figure 8:
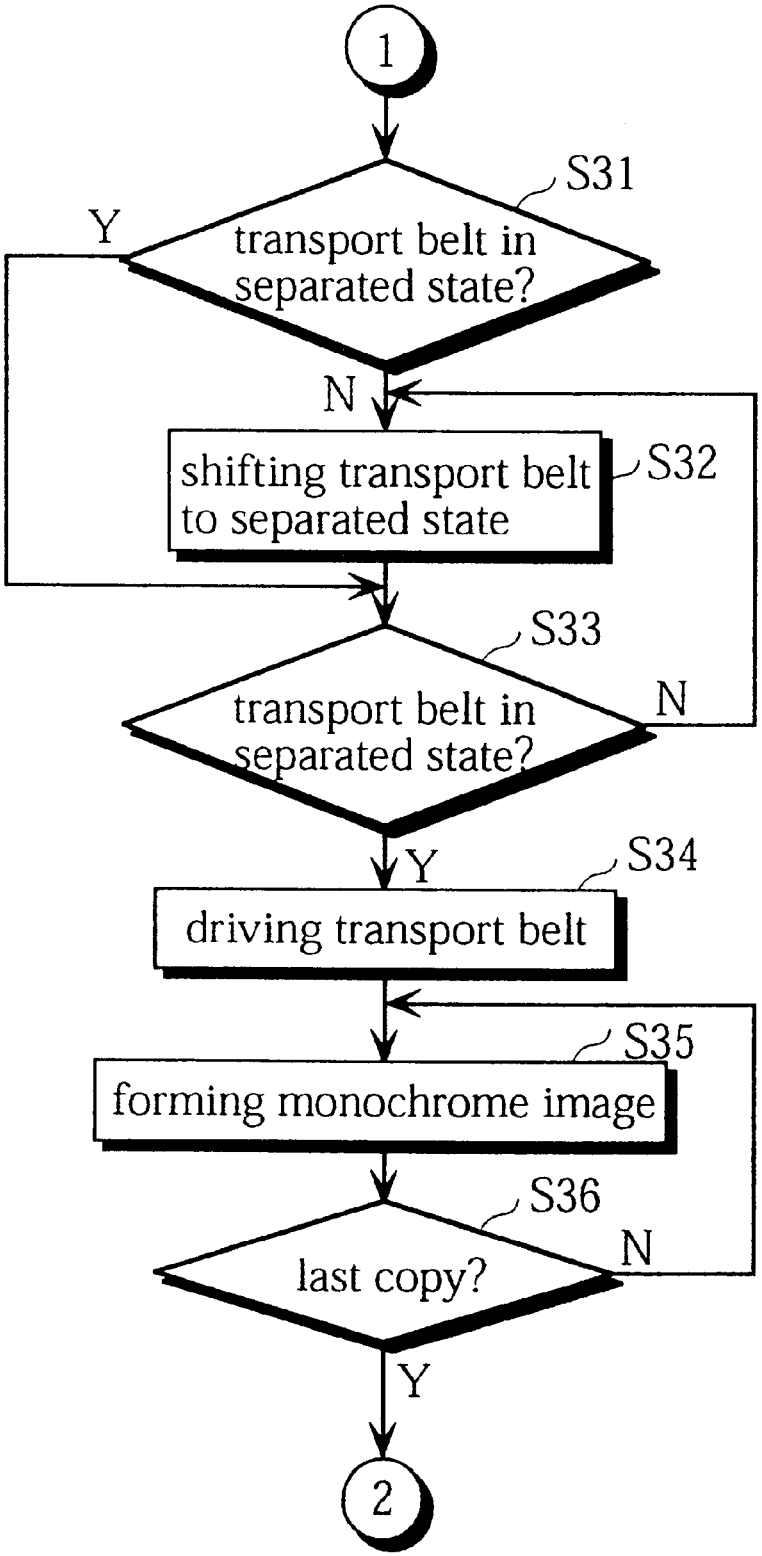
FIG. 8 is a flowchart included in the flowchart shown in FIG. 7.

FIGS. 7 and 8 are the flowcharts showing subroutines of the main routine (not illustrated) for the control operation of the entire copier. These subroutines are used for the image forming processing.

The flowchart shown in FIG. 7 is explained first. When a start key is pressed ("Y" in step S1), the CPU 31 judges whether the current copy mode is the color copy mode (step S2).

Here, the RAM 36 stores flags corresponding to the copy modes, one of which the user specifies before pressing the start key on the operation panel 90. Thus, the CPU 31 can easily judge the current copy mode by referring to the current flag.

When judging in step S2 that the color copy mode is set, the CPU 31 next judges whether the transport belt 41 is in the contacting state (step S3). This judgement can be made according to the detection signals from SE1 and SE2 (shown in FIG. 2) that respectively detect the contacting state and the separated state of the shift frame 46.

If the transport belt 41 is in the separated state ("N" in step S3), the CPU 31 drives the solenoid 47 to switch the state of the transport belt 41 to the contacting state (step S4). Then, when the transport belt 41 is in the contacting state ("Y" in step S5), the CPU 31 sets a displacement correction flag at "1" (step S6) and drives the transport belt 41 (step S7).

After a predetermined period of time until the running speed of the transport belt 41 reaches a system speed at which image formation is normally performed has elapsed so that the image formation is reliably controlled (step S8), the CPU 31 judges whether the displacement correction flag is set at "1" (step S9). If so, the CPU 31 executes the displacement detecting operation as described above in steps S10 to S12.

More specifically, the CPU 31 reads the data for printing the resist mark for each color from the ROM 37 and controls the image processing units 50M to 50K to form the resist marks 48M to 48K on the transport belt 41 as shown in FIG. 5 (step S10). Detecting the resist marks 48M to 48K using the resist mark detecting unit 39, the CPU 31 obtains the detection signal shown in FIG. 6 (step S11). Then, the CPU 31 calculates the displacements of the resist marks 48M to 48Y in the main scanning direction and the sub-scanning direction with the resist mark 48K being the standard mark. Simultaneously, the CPU 31 updates the previous displacement data for each resist mark stored in the RAM 36 (step S12).

On the completion of the displacement detecting operation, the CPU 31 resets the displacement correction flag and a count value P of the counter 38 to "0" (step S13).

The count value P indicates the number of color image formations counted by the counter 38 as described above. The counter 38 increments the count value P by "1" every time the color image formation is performed. When the displacement detecting operation is performed, the count value P is reset.

In accordance with the displacement data stored in the RAM 36, the CPU 31 corrects the storing position of each image data for Y, C, and M (step S14). Then, a full-color image is formed on the recording sheet according to the corrected image data (step S15).

Accordingly, when the copy mode is switched from the monochrome copy mode to the color copy mode and the state of the transport belt 41 returns to the contacting state, the displacement detecting operation is executed and the displacement data for each color is updated before the color image formation is performed. Thus, the shift of the transport belt 41 does not adversely affect the image formation and a high-quality color image without color displacements can be obtained.

When the displacement correction flag is not set at "1" in step S9, the CPU 31 judges that the displacement data does not need to be updated. In this case, the CPU 31 proceeds to step S16 and judges whether a color image is to be formed on a next recording sheet in a multi-copy operation. If not, i.e., if the color image is to be formed on the first recording sheet in the multi-copy operation or if image formation is performed in a case aside from the multi-copy operation, the CPU 31 can use the displacement data stored in the RAM 36 to have the corrected image (step S14). As a result, a full-color image is formed on the recording sheet according to the corrected image data (step S15).

When the CPU 31 judges the color image is to be formed on a next recording sheet in a multi-copy operation ("Y" in step S16), the corrected image data for the same document image has been stored in the corrected image memory of the displacement correcting unit 34. Therefore, the displacement detecting operation does not need to be performed again, and the full-color image is formed on the recording sheet according to the stored corrected image data (step S15).

Even when the current copy mode is not switched from the monochrome copy mode to the color copy mode, color displacements may be caused by gradual meandering of the transport belt 41 while copy operations are successively performed in the color copy mode. As such, the displacement data needs to be updated every predetermined number of image formations. More specifically, after the execution of the color image formation in step S15, the CPU 31 increments the count value P by "1" (step S17). When the count value P reaches a highest limit value "Pup" (step S18), the CPU 31 sets the displacement correction flag to "1" (step S19).

Note that the highest value "Pup" is the optimum number of image formations within tolerance. The value "Pup" has been calculated through experiments and stored in the ROM 37 beforehand.

If the count value P has not reached the highest value "Pup" ("N" in step S18), the CPU 31 does not need to update the displacement data and so proceeds to step S20.

The CPU 31 judges whether the previous copy operation is the last (step S20). Here, the user specifies the number of multi-copy operation when setting a document on the platen glass of the image reading unit 10. For example, suppose that the user specifies the number "K". The CPU 31 counts the number of image formations using an internal counter, and judges the previous copy operation is the last when a count value of the internal counter reaches "K". Meanwhile, when making a copy from each of documents using an ADF (automatic document feeder) provided for the image reading unit 10, the CPU 31 counts the number of documents when reading the document images. When the number of image formations counted by the internal counter reaches the number of documents, the CPU 31 judges the previous copy operation is the last. Alternatively, the CPU 31 may refer to the management table of the RAM 36.

When judging the previous copy operation is not the last ("N" in step S20), the CPU 31 repeats the processes from step S9 to step S19. When the copy operation for the last recording sheet is finished ("Y" in step S20), the CPU 31 stops the transport belt 41 and returns to the main routine (not illustrated).

If judging that the current copy mode is not the color copy mode ("N" in step S2), the CPU 31 proceeds to step S31 of the flowchart shown in FIG. 8 and judges whether the transport belt 41 is in the separated state.

If not ("N" in step S31), the CPU 31 drives the solenoid 47 to switch the state of the transport belt 41 to the separated state (step S32). Then, when the transport belt 41 is in the separated state ("Y" in step S33), the CPU 31 drives the transport belt 41 (step S34) and executes the image formation in the monochrome copy mode (step S35). Here, in the monochrome copy mode, the image is formed using only the photosensitive drum 51K which is located at a more downstream position than other photosensitive drums 51M to 51Y. The running speed of the transport belt 41 will become the system speed before the leading edge of the recoding sheet reaches the transfer position of the photosensitive drum 51K after the recording sheet was supplied to the transport belt 41. For this reason, the step which is performed in the color copy mode to wait for the predetermined period of time to elapse after the transport belt was driven, as in step S8 of FIG. 7, is not provided in the flowchart of FIG. 8.

After the image is transferred onto the recording sheet, the CPU 31 judges whether this copy operation was for the last (step S36). If not, the CPU 31 returns to step S35 to executes the next copy operation, and, if so, returns to step S21 to stop the transport belt 41 and returns to the main routine (not illustrated). Here, the subroutine for the image forming processing is terminated.

Second Embodiment

In the first embodiment, the displacement detecting operation is performed every time the state of the transport belt 41 is changed from the separated state to the contacting state. However, in the second embodiment, the displacement detecting operation is performed after the state of the transport belt 41 is changed from the separated state to the contacting state a predetermined number of times.

The following is a description of the construction and the operation of a copier 2 of the second embodiment. Note that the explanation of the common aspects with the first embodiment is omitted and only different aspects are described.

Figure 9:
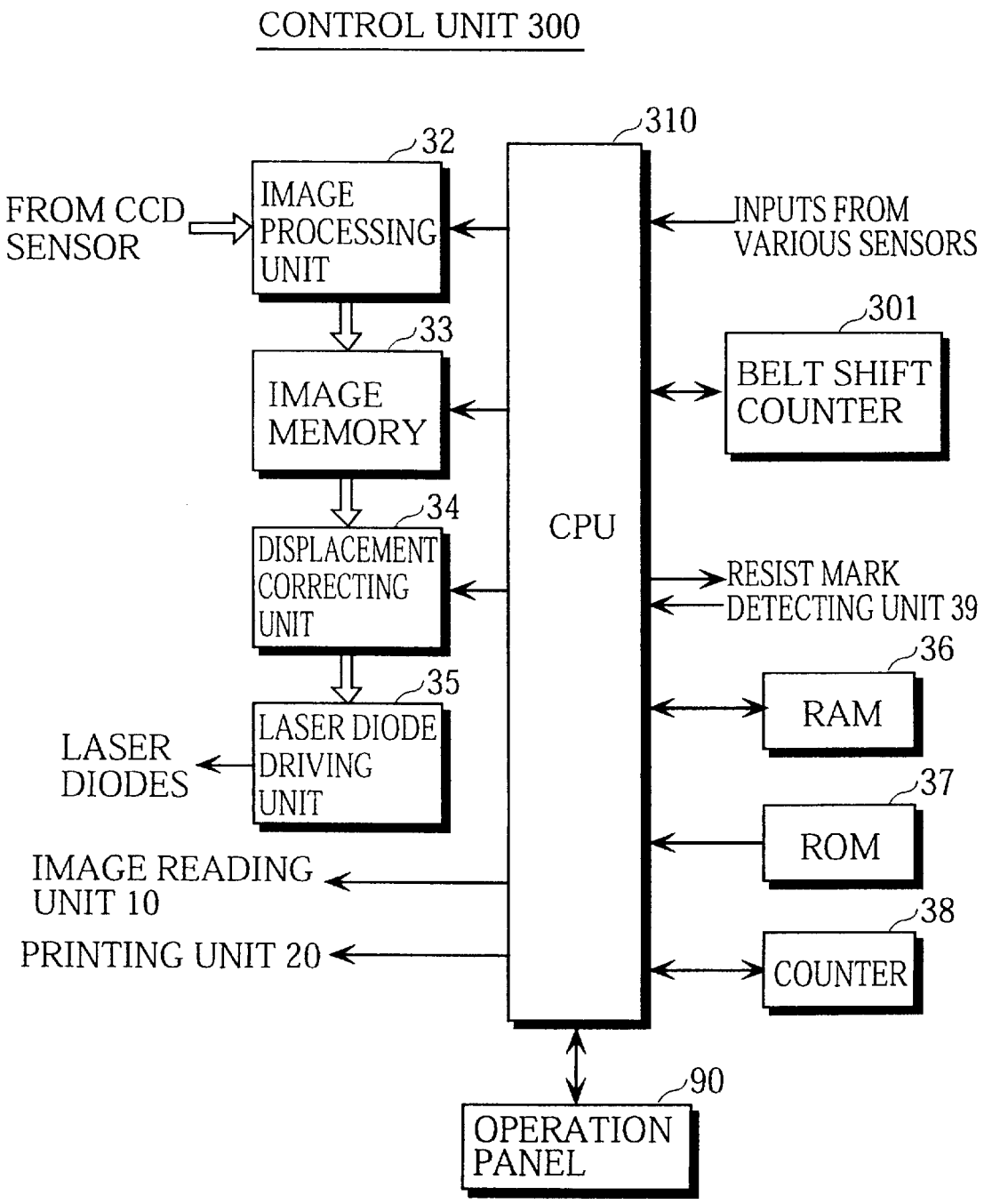
FIG. 9 is a block diagram showing a construction of a control unit provided in the tandem-type full-color image forming apparatus of the second embodiment of the present invention.

FIG. 9 is a block diagram showing the construction of a control unit 300 of the copier 2. A belt shift counter 301 is a unique component to the second embodiment. With the belt shift counter 301, a CPU 310 performs different processing from the processing performed by the CPU 31 of the first embodiment.

The belt shift counter 301 counts the number of times that the state of the transport belt 41 is changed from the separated state to the contacting state.

In addition to the processing performed by the CPU 31 of the first embodiment, the CPU 310 increments a count value of the belt shift counter 301 by "1" every time the solenoid 47 is driven to shift the transport belt 41 from the separated state to the contacting state. When the count value of the belt shift counter 301 reaches a predetermined threshold, the CPU 310 resets the count value to "0" as well as setting the displacement correction flag at "1". On the other hand, when the count value is less than the predetermined threshold, the CPU 310 keeps the displacement correction flag at "0".

The predetermined threshold which is compared with the count value of the belt shift counter 301 has been obtained as a result of experiments which were performed for the purpose of ascertaining the relation between the number of shifts of the transport belt 41 and the extent of color displacements on the transferred image. This threshold is stored in the ROM 37.

Figure 10:
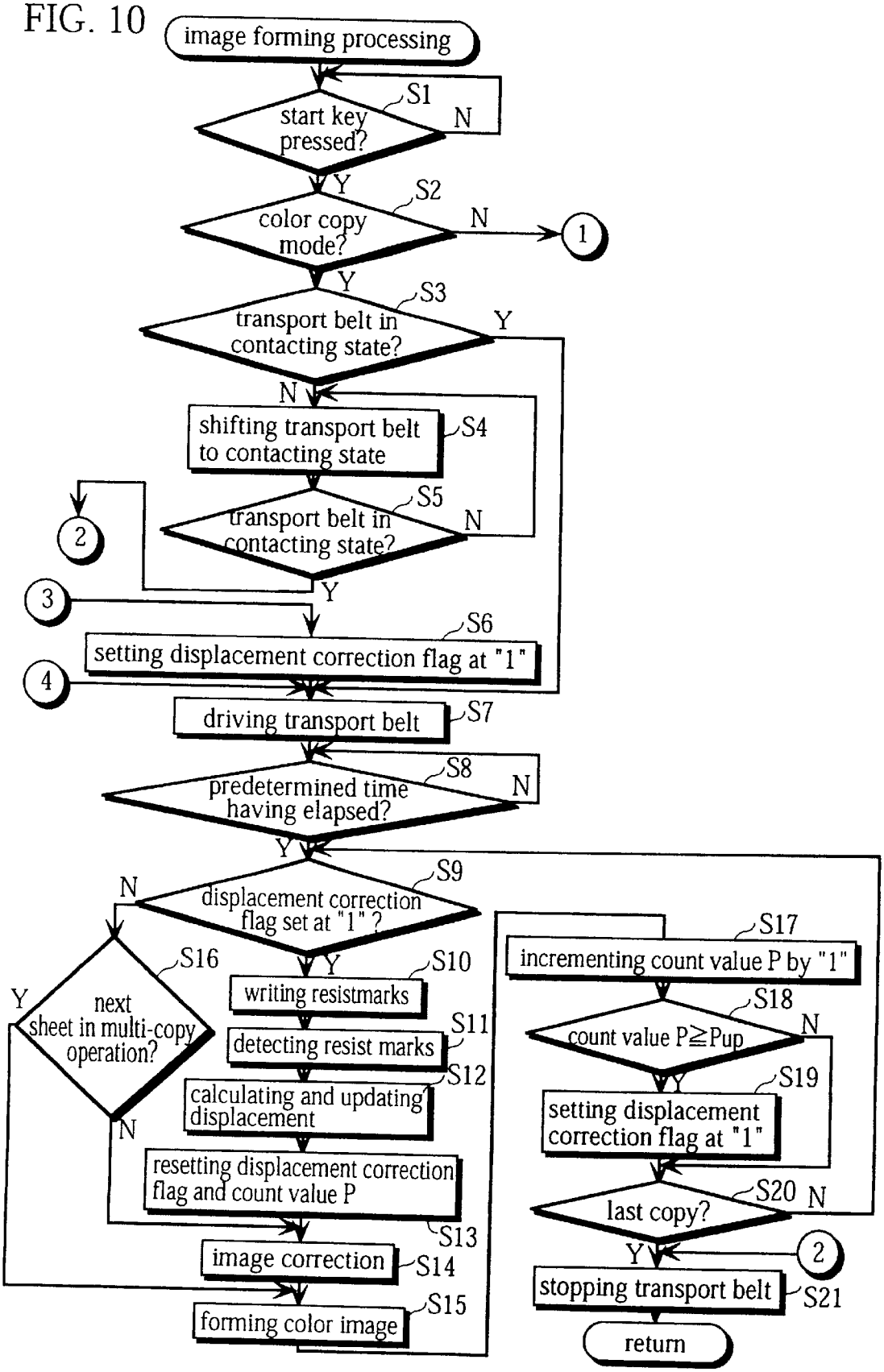
FIG. 10 is a flowchart showing an operation for the image forming processing performed by the control unit.
Figure 11:
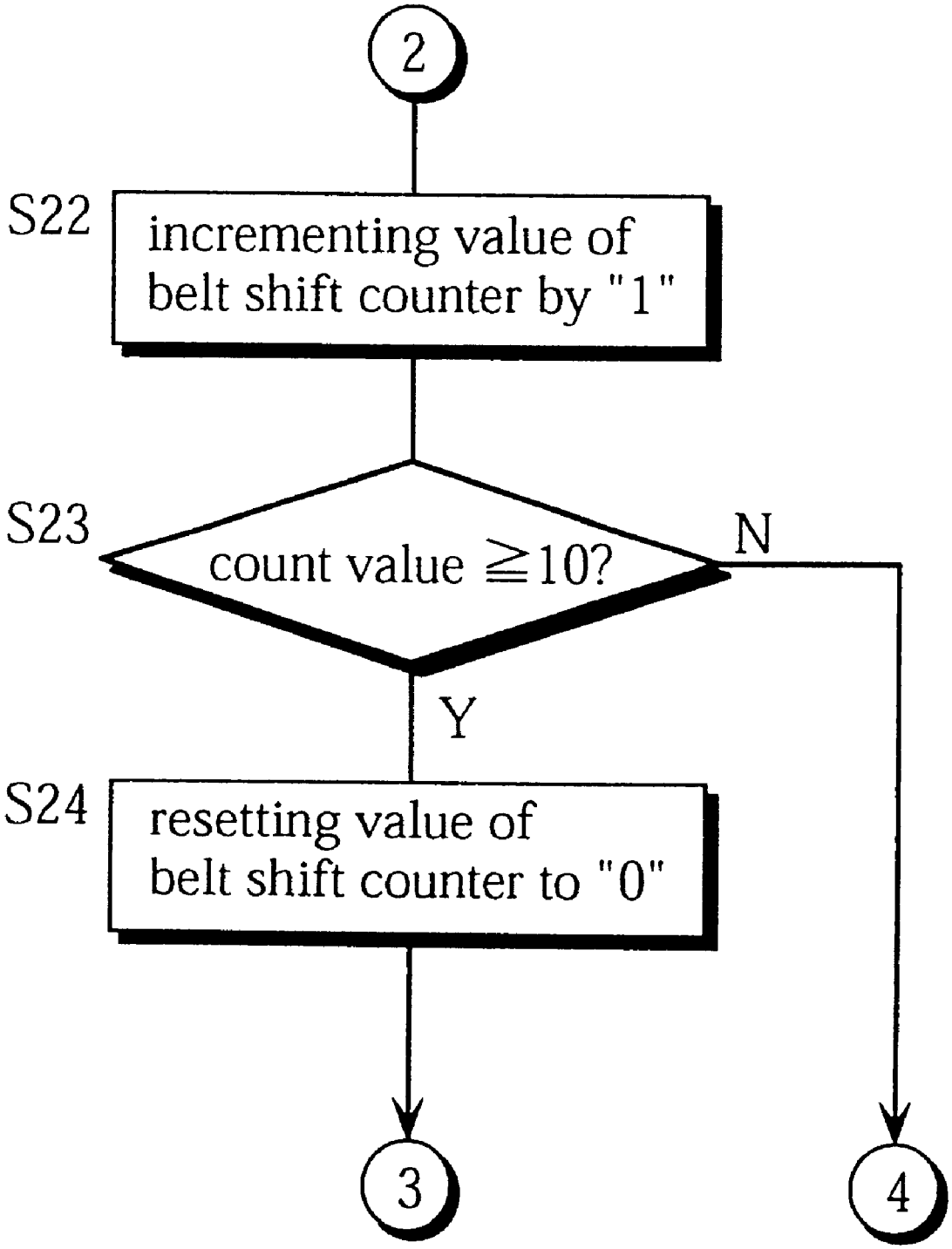
FIG. 11 is a flowchart included in the flowchart shown in FIG. 10.

FIGS. 10 and 11 are the flowcharts showing subroutines of the main routine (not illustrated) for the control operation of the entire copier 2 of the second embodiment. These subroutines are used for the image forming processing.

The flowchart shown in FIG. 10 is basically the same as the flowchart shown in FIG. 7, aside from the added steps S22 to S24 which are performed by the CPU 310. Therefore, the explanation of the same steps is omitted and only the different steps are described below.

Steps S1 to S4 in FIG. 10 is the same as those steps in FIG. 7. When the transport belt 41 has been shifted to the contacting state ("Y" in step S5), the CPU 310 proceeds to step S22 in FIG. 11 and increments the value of the belt shift counter 301 by "1". Next, the CPU 310 compares the current value of the belt shift counter 301 with the predetermined threshold, "10" in the present example. If the current value of the belt shift counter 301 is equal to or more than "10" ("Y" in step S23), the CPU 310 resets the value of the belt shift counter 301 to "0" (step S24) and returns to step S6 to set the displacement correction flag at "1". Meanwhile, if the current value of the belt shift counter 301 is less than "10" ("N" in step S23), the CPU 310 keeps the displacement correction flag at "0" and executes the processes from step S7 onwards that are the same as in the flowchart shown in FIG. 7.

When using the copier 2 of the second embodiment, the displacement detecting operation is not performed every time the state of the transport belt 41 is changed from the separated state to the contacting state. The displacement detecting operation is performed after the shift operation from the separated state to the contacting state is performed the predetermined number of times. As a result, the load on the displacement correction processing can be reduced. In addition, since the predetermined number of times is set in accordance with the ascertained relation between the number of shifts of the transport belt 41 and the extent of color displacements so that no image deterioration occurs, the quality of a transferred image is guaranteed.

Modifications

The present invention has been described in accordance with the first and second embodiments. It should be obvious that the present invention is not limited to these embodiments, so that the following modifications can be made.

(1) In the stated embodiments, the displacement correction processing is performed by calculating displacements in accordance with the detection result given by the resist mark detecting unit 39 and generating the corrected image data using the displacement correcting unit 34 according to the calculated displacements. The displacement correction processing may also be achieved by controlling start timings at which the images are written on the photosensitive drums in the main scanning direction and the sub-scanning direction.

(2) In the stated embodiments, the solenoid 47 is driven to shift the shift frame 46 (shown in FIG. 2) supporting the driving roller 42 upward and downward, so that the transport belt 41 is in contact with all of the photosensitive drums in the color copy mode and separated from the photosensitive drums which are not used for forming the image in the monochrome mode. However, a component for shifting the shift frame 46 is not limited to the stated solenoid. For example, an actuator or a cam mechanism may be used. Although the transport belt 41 is separated from the photosensitive drums in the monochrome copy mode in the stated embodiments, the method for separating the photosensitive drums and the transport belt is not limited to this. For example, the photosensitive drums which are not used in the monochrome copy mode may be shifted upward to separate them from the transport belt.

(3) Although the user inputs the copy mode using the operation panel 90, a document judging unit, for example, may be provided for judging that each document is color or monochrome based on the image data of the document read by the image reading unit 10. In accordance with the judgement result, the copy mode may be automatically set. For judging whether the document is color or monochrome, the CPU may obtain Chroma (C*) data for each pixel from the R, G, and B image data obtained by the image reading unit 10, and count the number of pixels which include a predetermined Chroma (C*). If the ratio of the number of chromatic pixels to the number of pixels in the page is equal to or higher than a predetermined ratio (for example, 0.1%), the document may be judged to be a color document.

(4) Although the present invention has been described for the copier by which the images are transferred onto the recording sheet directly by the photosensitive drums, the present invention is not limited to this. For example, a copier by which the images formed on the photosensitive drums are transferred onto the transport belt first and the superimposed image formed on the transport belt is then transferred onto the recording sheet may be used.

Alternatively, when the displacement detecting operation is performed, a recording sheet may be supplied and the resist marks may be formed on the recording sheet. Then, the resist mark detecting unit 39 may detects the displacements from these resist marks. In this case, although the recording sheet is used only for detecting the displacements, the resist marks transferred onto the recording sheet is clear, so that a high degree precision in the displacement detecting operation can be obtained. In addition, even when the transport belt is deformed, precise displacements can be detected more reliably without adverse effects from the deformed transport belt.

(5) The resist mark is not limited to the V-shaped mark as long as the resist mark is composed of two lines, with one line being parallel to the sub-scanning direction and an angle being formed between the two lines. In the stated embodiments, the angle is set at 45° which is convenient to calculate the displacement in the main scanning direction. However, the angle is not limited to this and another angle may be used for calculating the displacement using a trigonometric function.

(6) Although a tandem-type full-color copier is described as the present invention in the first and second embodiments, the present invention is not limited to this. For example, a tandem-type full-color image forming apparatus, such as a laser printer, can be used.

(7) A tandem-type full-color copier is described as the present invention in the stated embodiments. However, the present invention is not limited to the tandem-type copier, and a full-color copier by which the images formed by a plurality of image forming units are transferred onto a recording material to form one image can be used.

(8) A tandem-type full-color copier which switches the copy mode between the color copy mode and the monochrome copy mode is described as the present invention in the first and second embodiments. The present invention, however, can be used for an image forming apparatus having a plurality of image forming units which switches the current state between a state where all image forming units are in contact with the transport belt and a state where at least one image forming unit is in contact with the transport belt.

Although the present invention has been fully described by way of examples with reference to the accompanying drawings, it is to be noted that various changes and modifications will be apparent to those skilled in the art.

Therefore, unless such changes and modifications depart from the scope of the present invention, they should be constructed as being included therein.

What is claimed is:

1. An image forming apparatus comprising:

an image holding component for holding an image;

a first image forming device for forming a first image on a surface of the image holding component;

a second image forming device for forming a second image on the surface of the image holding component;

a switching unit for switching a mode between a first mode and a second mode, the first mode being where the first image forming device and the second image forming device come into contact with the image holding component and the second mode being where the second image forming device and the image holding component do not come into contact and the first image forming device comes into contact with the image holding component;

a detecting unit for detecting information concerning an image formed on the surface of the image holding component in relation to switching from the second mode to the first mode; and a modifying unit for modifying at least one of an image forming condition for the first image and an image forming condition for the second image, in accordance with the information detected by the detecting unit.

2. The image forming apparatus of claim 1, wherein the image holding component is one of a recording sheet and a transfer component that is used for transferring the image onto a recording sheet.

3. The image forming apparatus of claim 2, wherein each of the first image forming device and the second image forming device includes a developer image holding component, wherein the developer image holding component comes into contact with the image holding component and transfers a developer image onto the image holding component.

4. The image forming apparatus of claim 3 further comprising a transporting unit, wherein the image holding component is a recording sheet, wherein the transporting unit transports the recording sheet, and wherein the first image forming device and the second image forming device are set in line along the transporting unit in a transporting direction of the recording sheet.

5. The image forming apparatus of claim 4, wherein the switching unit includes a construction for moving a partial surface of the transporting unit away from the second image forming device and toward the second image forming device, the partial surface of the transporting unit facing the second image forming device.

6. The image forming apparatus of claim 5, wherein the information concerning the image detected by the detecting unit is a displacement of the image formed by the first image forming device and the second image forming device, the image being a resist mark which is formed on one of the transporting unit and the recording sheet on the transporting unit.

7. The image forming apparatus of claim 6, wherein resist mark forming control is performed when a predetermined period of time has elapsed after the switching unit switched the mode from the second mode to the first mode.

8. The image forming apparatus of claim 7, wherein each resist mark is composed of a first line mark and a second line mark, with the first line mark forming a right angle with the transporting direction of the recording sheet and a certain angle being formed between the first line mark and the second line mark, wherein the detecting unit includes a photo sensor which is set at a more downstream side in the transportation direction of the recording sheet than the first image forming device and the second image forming device, and wherein the detecting unit obtains information related to writing positions of the first image and the second image on the image holding component, in accordance with a timing when the photo sensor detects the first line mark and a difference between timings when the photo sensor detects the first line mark and the second line mark.

9. The image forming apparatus of claim 8, wherein the modifying unit modifies a developer image forming position on each of the developer image holding components of the first image forming device and the second image forming device in accordance with the timing and the difference.

10. The image forming apparatus of claim 9, wherein detecting control is performed after the switching unit switches the mode from the second mode to the first mode.

11. The image forming apparatus of claim 9, wherein the detecting unit further includes a first counter, the first counter counting a number of times the switching unit switches the mode from the second mode to the first mode, and wherein detecting control is performed when the number of times counted by the first counter reaches a predetermined number of times.

12. The image forming apparatus of claim 9, wherein the detecting unit further includes a second counter, the second counter counting a number of image formations successively performed in the first mode, and wherein detecting control is performed when the number of image formations counted by the second counter reaches a predetermined number.

13. The image forming apparatus of claim 12, wherein the modifying unit further includes a storing device for storing modification results of the developer image forming positions where the first image and the second image are formed, wherein the first image forming device and the second image forming device use modification results stored in the storing device when a same image is formed in a successive image formation, the same image being composed of the first image and the second image.

14. An image forming apparatus comprising:

an image holding component for holding an image;

a first image forming device for forming a first image on a surface of the image holding component and including a photosensitive component, a latent image forming unit for forming a latent image on the photosensitive component, and a developing unit for developing the latent image;

a second image forming device for forming a second image on the surface of the image holding component and including at least two photosensitive components, at least two latent image forming units for each forming a latent image on the corresponding photosensitive component, and at least two developing units for each developing the corresponding latent image;

a switching unit for switching a mode between a first mode and a second mode, the first mode being where the first image forming device and the second image forming device come into contact with the image holding component and the second mode being where the second image forming device and the image holding component do not come into contact and the first image forming device comes into contact with the image holding component;

a detecting unit for detecting information concerning an image formed on the surface of the image holding component in relation to switching from the second mode to the first mode; and a modifying unit for modifying at least one of an image forming condition for the first image and an image forming condition for the second image, in accordance with the information detected by the detecting unit, wherein the first image forming device forms a black image on the photosensitive component, and the second image forming device forms an image of a different color on each of the photosensitive components, with none of the different colors being black.

15. The image forming apparatus of claim 14, wherein the image holding component is one of a recording sheet and a transfer component that is used for transferring the image onto a recording sheet.

16. The image forming apparatus of claim 14 further comprising a transporting unit, wherein the image holding component is a recording sheet, wherein the transporting unit transports the recording sheet, wherein the first image forming device and the second image forming device are set in line along the transporting unit in a transporting direction of the recording sheet, wherein transfer control is performed to transfer different color images formed on the photosensitive components onto the recording sheet at a same position so that the different color images are superimposed.

17. The image forming apparatus of claim 16, wherein the switching unit includes a construction for moving a partial surface of the transporting unit away from the second image forming device and toward the second image forming device, the partial surface of the transporting unit facing the second image forming device.

18. The image forming apparatus of claim 17, wherein the information concerning the image detected by the detecting unit is a displacement of the image formed by the first image forming device and the second image forming device, the image being a resist mark which is formed on one of the transporting unit and the recording sheet on the transporting unit.

19. The image forming apparatus of claim 18, wherein resist mark forming control is performed when a predetermined period of time has elapsed after the switching unit switched the mode from the second mode to the first mode.

20. The image forming apparatus of claim 19, wherein each resist mark is composed of a first line mark and a second line mark, with the first line mark forming a right angle with the transporting direction of the recording sheet and a certain angle being formed between the first line mark and the second line mark, wherein the detecting unit includes a photo sensor which is set at a more downstream side in the transportation direction of the recording sheet than the first image forming device and the second image forming device, and wherein the detecting unit obtains information related to writing positions of the first image and the second image on the photosensitive components, in accordance with a timing when the photo sensor detects the first line mark and a difference between timings when the photo sensor detects the first line mark and the second line mark.

21. The image forming apparatus of claim 20, wherein the modifying unit modifies an image forming position on each of the photosensitive components of the first image forming device and the second image forming device in accordance with the timing and the difference.

22. The image forming apparatus of claim 21, wherein detecting control is performed after the switching unit switches the mode from the second mode to the first mode.

23. The image forming apparatus of claim 21, wherein the detecting unit counts a number of times the switching unit switches the mode from the second mode to the first mode and detects the information related to the image forming position on each of the photosensitive components after the mode has been switched from the second mode to the first mode a predetermined number of times.

24. The image forming apparatus of claim 21, wherein the detecting unit counts a number of image formations successively performed in the first mode, and detects the information related to the writing positions of the first image and the second image on the photosensitive components when the number of image formations reaches a predetermined number.

25. The image forming apparatus of claim 24, wherein the modifying unit includes a storing device for storing modification results of the image forming positions where the first image forming device and the second image forming device respectively form images, wherein the first image forming device and the second image forming device respectively form the images on the photosensitive components in accordance with the modification results stored in the storing device.

26. An image forming apparatus comprising:

an image holding component for holding an image;

a first image forming device which includes a first developer image holding component facing the image holding component and forms a first developer image on a surface of the first developer image holding component;

a second image forming device which includes a second developer image holding component facing the image holding component and forms a second developer image on a surface of the second developer image holding component;

a switching unit for switching a mode between a first mode and a second mode, the first mode being where the first developer image holding component and the second developer image holding component come into contact with the image holding component and the second mode being where the second developer image holding component and the image holding component do not come into contact and the first developer image holding component comes into contact with the image holding component;

a transfer unit for transferring the first developer image and the second developer image onto a surface of the image holding component;

a detecting unit for detecting information concerning an image formed on the surface of the image holding component in relation to switching from the second mode to the first mode; and a modifying unit for modifying at least one of an image forming condition for the first image and an image forming condition for the second image, in accordance with the information detected by the detecting unit.

27. The image forming apparatus of claim 26, wherein the image holding component is one of a recording sheet and a transfer component that is used for transferring the image onto a recording sheet.

28. The image forming apparatus of claim 26 further comprising a transporting unit, wherein the image holding component is a recording sheet, wherein the transporting unit transports the recording sheet, and wherein the first developer image holding component and the second developer image holding component are set in line along the transporting unit in a transporting direction of the recording sheet.

29. The image forming apparatus of claim 28, wherein the switching unit includes a construction for moving a partial surface of the transporting unit away from the second developer image holding component and toward the second developer image holding component, the partial surface of the transporting unit facing the second developer image holding component.

30. An image forming apparatus comprising:

an image holding component for holding an image;

a first image forming device for forming a first image on a surface of the image holding component;

a second image forming device for forming a second image on the surface of the image holding component;

a switching unit for switching a mode between a first mode and a second mode, the first mode being where the first image forming device and the second image forming device come into contact with the image holding component and the second mode being where the second image forming device and the image holding component do not come into contact and the first image forming device comes into contact with the image holding component;

a resist mark forming unit for forming a resist mark for each of the first image forming device and the second image forming device on the image holding component in relation to switching from the second mode to the first mode;

a detecting unit for detecting information related to a position of each resist mark formed on the image holding component; and a modifying unit for modifying at least one of an image forming condition for the first image and an image forming condition for the second image, in accordance with the information detected by the detecting unit.

31. The image forming apparatus of claim 30, wherein the image holding component is one of a recording sheet and a transfer component that is used for transferring the image onto a recording sheet.

32. The image forming apparatus of claim 30 further comprising a transporting unit, wherein the image holding component is a recording sheet, wherein the transporting unit transports the recording sheet, and wherein the first image forming device and the second image forming device are set in line along the transporting unit in a transporting direction of the recording sheet.

33. The image forming apparatus of claim 32, wherein each resist mark is composed of a first line mark and a second line mark, with the first line mark forming a right angle with the transporting direction of the recording sheet and a certain angle being formed between the first line mark and the second line mark, wherein the detecting unit includes a photo sensor which is set at a more downstream side in the transportation direction of the recording sheet than the first image forming device and the second image forming device, and wherein the detecting unit obtains information related to writing positions of the first image and the second image on the image holding component, in accordance with a timing when the photo sensor detects the first line mark and a difference between timings when the photo sensor detects the first line mark and the second line mark.

34. The image forming apparatus of claim 33, wherein detecting control is performed after the switching unit switches the mode from the second mode to the first mode.

35. The image forming apparatus of claim 33, wherein the detecting unit further includes a first counter, the first counter counting a number of times the switching unit switches the mode from the second mode to the first mode, and wherein detecting control is performed when the number of times counted by the first counter reaches a predetermined number of times.

36. The image forming apparatus of claim 35, wherein the modifying unit modifies a first image forming position and a second image forming position on the image holding component in accordance with the timing and the difference.

37. An image forming apparatus comprising:

an image holding component for holding an image, the image being composed of pixels;

a first image forming device for forming a first image on a surface of the image holding component;

a second image forming device for forming a second image on the surface of the image holding component;

a switching unit for switching a mode between a first mode and a second mode, the first mode being where the first image forming device and the second image forming device come into contact with the image holding component and the second mode being where the second image forming device and the image holding component do not come into contact and the first image forming device comes into contact with the image holding component;

a detecting unit for detecting information concerning a position of an image on the surface of the image holding component in relation to switching from the second mode to the first mode, with the image being composed of pixels; and a modifying unit for modifying the position of one of the first image and the second image by pixels, in accordance with the information detected by the detecting unit.

38. The image forming apparatus of claim 37, wherein the modifying unit further includes a storing device for storing a modification result of a pixel position, wherein the first image forming device and the second image forming device use modification results stored in the storing device when a same image is formed in a successive image formation, the same image being composed of the first image and the second image.

39. The image forming apparatus of claim 1, wherein the information concerning the image detected by the detecting unit is a displacement of the image formed by the first image forming device and the second image forming device, the image being resist mark which is formed on the image holding component.

40. The image forming apparatus of claim 39, wherein resist mark forming control is performed when a predetermined period of time has elapsed after the switching unit switched the mode from the second mode to the first.

41. The image forming apparatus of claim 1, wherein the detecting unit further includes a first counter, the first counter counting a number of times switching unit switches the mode from the second mode to the first mode, and detecting control is performed when the number of times counted by the first counter reaches a predetermined number of times.

42. The image forming apparatus of claim 1, wherein the detecting unit further includes a counter, the counter counting a number of image formations successively performed in the first mode, and detecting control is performed when the number of image formations counted by the counter reaches a predetermined number.

43. An image forming apparatus comprising:

an image holding component for holding an image;

a plurality of image forming devices for forming images of different colors on a surface of the image component;

a switching unit for switching a mode between a first mode and a second mode, the first mode being where the plurality of image forming devices form the images on the image holding component with the formed images being superimposed and the second mode being where one of the plurality of image forming devices forms the image on the image holding component;

a detecting unit for detecting information related to a displacement of the images formed by the plurality of the image forming devices on the surface of the image holding component in relation to switching from the second mode to the first mode; and a modifying unit for modifying an image forming position of each of the plurality of the image forming devices on the image holding component, in accordance with the information detected by the detecting unit.

44. The image forming apparatus of claim 43, wherein detecting control is performed when a predetermined period of time has elapsed after the switching unit switched the mode from the second mode to the first mode.

45. The image forming apparatus of claim 43, further comprising a first counter for counting a number of times the switching unit switches the mode from the second mode to the first mode, wherein detecting control is performed when the number of times counted by the first counter reaches a predetermined number of times.

46. The image forming apparatus of claim 43, further comprising a counter for counting a number of image formations successively performed in the first mode, wherein detecting control is performed when the number of image formations counted by the counter reaches a predetermined number.

47. The image forming apparatus of claim 43, further comprising a transporting unit, wherein the image holding component is a recording sheet, the transporting unit transports the recording sheet, and the plurality of image forming devices are set along the transporting unit in a transporting direction of the recording sheet.

48. The image forming apparatus of claim 47, wherein all of the plurality of image forming devices come into contact with transporting unit in the first mode, and the one of the plurality of image forming devices comes into contact with the transporting unit and the others of the plurality of image forming devices do not come into contact with the transporting unit in the second mode.

49. The image forming apparatus of claim 30, wherein detecting control is performed when a predetermined period of time has elapsed after the switching unit switched the mode from the second mode to the first mode.

50. The image forming apparatus of claim 30, further comprising a first counter for counting a number of times the switching unit switches the mode from the second mode to the first mode, wherein detecting control is performed when the number of times counted by the first counter reaches a predetermined number of times.

51. The image forming apparatus of claim 30, further comprising a counter for counting a number of image formations successively performed in the first mode.

wherein detecting control is performed when the number of image formations counted by the counter reaches a predetermined number.

* * * * *